US005646672A

United States Patent [19]

Fukushima

[11] Patent Number: 5,646,672

[45] Date of Patent: Jul. 8, 1997

[54] THERMAL HEAD APPARATUS

[75] Inventor: Itaru Fukushima, Tokyo, Japan

[73] Assignee: NEC Corporation, Tokyo, Japan

[21] Appl. No.: 572,106

[22] Filed: Dec. 14, 1995

[30] Foreign Application Priority Data

Dec. 16, 1994 [JP] Japan ..... 6-313563

[51] Int. Cl.[6] ..... B41J 2/355; B41J 2/365

[52] U.S. Cl. ..... 347/211; 347/194

[58] Field of Search ..... 347/194, 211; 400/120.14

[56] References Cited

U.S. PATENT DOCUMENTS 5,132,709 7/1992 West ..... 347/194
5,422,662 6/1995 Fukushima et al. ..... 347/211

FOREIGN PATENT DOCUMENTS 0562626 3/1993 European Pat. Off. .

OTHER PUBLICATIONS

Patent Abstracts of Japan, Abstract of JP–A 63–49459.
Patent Abstracts of Japan, Abstract of JP–A 59–143660.
Patent Abstracts of Japan, Abstract of JP–A 58–14784.
Patent Abstracts of Japan, Abstract of JP–A 60–110475.

*Primary Examiner*—Huan H. Tran
*Attorney, Agent, or Firm*—Sughrue, Mion, Zinn, Macpeak & Seas

[57] ABSTRACT

The invention provides a thermal head apparatus of the type which includes, as a heat generation element, a resistor member whose resistance value varies depending upon the temperature thereof, wherein the accuracy in detection of the temperature of a medium is improved to assure an improved quality of printing. The thermal head apparatus includes a plurality of heat generating resistance elements and having an electric resistance whose value varies depending upon a temperature thereof, a heat generation driving and temperature detection circuit for first driving the resistance elements in accordance with print data to generate heat and then successively detecting voltages across the resistance elements to detect temperatures of them, a control circuit for comparing the thus detected temperatures with the print data and controlling the heat generation driving function of the heat generation driving and temperature detection circuit based on results of the comparison, and a switch for switching the heat generation driving and temperature detection circuit between a heat generation driving condition and a temperature detection condition.

3 Claims, 7 Drawing Sheets

THERMAL HEAD APPARATUS

BACKGROUND OF THE INVENTION

1. Field of the Invention

This invention relates to a thermal head apparatus, and more particularly to a thermal head apparatus which is suitably applied to a comparatively inexpensive thermal printer of a small size.

2. Description of the Related Art

Conventionally, when a thermal head apparatus of the type mentioned is used to print at a high speed, the temperature of the thermal head itself rises gradually due to a heat accumulating action of the thermal head itself, and as printing proceeds, the printing density increases gradually, resulting in defective printing of collapsing printed characters or elongated printed characters. Therefore, a heat accumulation correction circuit is provided for a printing control circuit in order to allow high speed printing. However, not for character printing but for printing of a shading pattern which includes crowded dots, a large scale control circuit is required. Further, in recent years, a printing method which realizes color printing with thermosensible paper has been developed and put into practical use. In order to perform shading printing with gradations by the printing method, finer temperature control of heat generation elements than ever is required, and conventional thermal head printing control methods cannot always satisfy the requirement sufficiently.

As a solution to the problem, a thermal head apparatus has been proposed wherein resistor elements each having a resistance value which varies depending upon the temperature thereof by heat generated by the same are employed as heat generation elements and are controlled by a control circuit which Includes a plurality of comparatively inexpensive general purpose integrated circuits in order to allow comparatively fine printing temperature control. The thermal head apparatus employs a control method wherein, in a process of driving the heat generation elements, whose resistance values vary depending upon the temperatures thereof, with electric currents to generate heat which causes temperature rises of the heat generation elements, the temperatures of the heat generation elements are detected repetitively and, when a predetermined temperature of a heat generation element is detected, the driving of the heat generation elements with electric current is stopped. The thermal head apparatus described above will be described in more detail below with reference to FIGS. 4, 5 and 6.

Referring first to FIG. 4, a thermal head denoted at 50 includes 64 heat generation elements R1 to R64, a heat generation driving integrated circuit 80 and an electric current detecting integrated circuit 58. The heat generation driving integrated circuit 80 includes a shift register circuit 801, a latch circuit 802, an output gate circuit 803, and 64 output transistors Q1 to Q64. Meanwhile, the electric current detecting integrated circuit 58 includes a shift register circuit 181, a latch circuit 182, an output gate circuit 183, and output transistors q1 to q64. All of the heat generation elements R1 to R64 are connected at one ends thereof to a common electrode 52, to which a dc power source voltage VHD for driving the thermal head apparatus is applied. The other ends of the heat generation elements R1 to R64 are connected to the heat generation driving integrated circuit 80 by way of respective electric current detecting resistors r1 to r64. The other ends of the heat generation elements R1 to R64 are connected also to the electric current detecting integrated circuit 58.

As seen from FIG. 5, print input data Din are inputted in the form of a serial signal together with a synchronizing signal D-Clock to the shift register circuit 801 and then transferred at a time to the latch circuit 802 at the timing of a latch signal D-Latch. The output gate circuit 803 turns on the output transistors Q1 to Q64 in response to the print data transferred to the latch circuit 802 and keeps the on-state of the output transistors Q1 to Q64 for a period of time within which a strobe signal D-Strobe exhibits a low (L) level to flow electric currents through the heat generation elements R1 to R64 to generate heat.

In this instance, the electric currents I1 to I64 flowing through the heat generation elements R1 to R64 substantially depend upon the dc power source voltage VHD and the resistance values of the heat generation elements R1 to R64. Further, since the resistance values of the heat generation elements R1 to R64 vary by a great amount depending upon the temperature, also the flowing electric currents vary by a great amount by heat generation upon printing. In other words, the electric currents I1 to I64 and the temperatures of the heat generation elements R1 to R64 have a correlation, and the temperatures of the heat generation elements R1 to R64 can be detected from the values of the electric currents I1 to I64. Further, the electric currents I1 to I64 have a proportional relationship to the voltages appearing across the electric current detecting resistors r1 to r64. Accordingly, the voltages are extracted to the outside in the form of an external serial signal Sout of the thermal head 10 by way of the electric current detecting integrated circuit 58.

A serial input Sin to the electric current detecting integrated circuit 58 includes data of "1" of a high level only at one bit at the top thereof while the other bits of the serial input Sin exhibit a low level. The serial input Sin is inputted to the shift register circuit 181 in response to a clock signal S-Clock. The data "1" of one bit thus inputted is transferred to the latch circuit 182 at the timing of a latch signal S-Latch. The clock signal S-Clock and the latch signal S-Latch have an equal period but the latch signal S-Latch is delayed a little in timing with respect to the clock signal S-Clock. Thus, as the serial input Sin is successively shifted in the shift register circuit 181, the output transistors q1 to q64 are successively turned on in the reverse order, and consequently, the voltages across the electric current detecting resistors r1 to r64 successively pass, from the electric current detecting resistor r1 side toward the electric current detecting resistor r64 side, through the corresponding output transistors q1 to q64 and outputted to the external serial signal Sout.

Signals corresponding to the electric currents I1 to I64 which have a correlation to the temperatures of the heat generation elements R1 to R64 are extracted from the terminal Sout and transferred to a control circuit 42 shown in FIG. 6 which is provided outside the thermal head 50. Referring now to FIG. 6, in the thermal head 50, the signals are successively converted into digital amounts by an analog to digital (A/D) converter 421 and then compared with a temperature set by a setting unit 423 by a comparator 422. When a temperature represented by any of the signals is lower than the set temperature, a signal of a high (H) level is produced by the comparator 422, but when the temperature is equal to or higher than the set temperature, a signal of a low (L) level is produced. The thus produced signal is fed back to the serial input Din of the thermal head 50. The sequence of operations described above is repeated for each one period of the clock signal D-Clock and the clock signal S-Clock for the heat generation driving integrated circuit 80 and the electric current detecting integrated circuit 58, respectively.

Referring also to FIG. 4, the clock signals for the shift register circuit 801 of the heat generation driving integrated circuit 80 and the shift register circuit 181 of the electric current detecting integrated circuit 58 are synchronized with each other, and the output terminals of the output transistors Q1 to Q64 and q1 to q64 of the integrated circuits 80 and 58 connected to the electric current detecting resistors r1 to r64 are connected to each other such that the terminal numbers of them are reverse to each other in order. Consequently, the signal outputted from the terminal Sout of the electric current detecting integrated circuit 58 coincides with the controlled print data in terms of both of the timing and the sequential order.

For each printing cycle, energy for printing is applied by a plurality of times to the heat generation elements R1 to R64, and the temperatures of the heat generation elements R1 to R64 at the instant of each application are detected. Then, subsequent application of the printing energy to any of the heat generation elements R1 to R64 which exhibits a temperature equal to or higher than the set temperature is stopped. In this instance, print data Datain for the first application time in each printing cycle are transferred from the control circuit 42, but at and after the second application time, data of the shift register circuit 801 are cyclically transferred and used. Such switching is performed in response to a selection signal Select. In this instance, the comparator signal from the comparator 422 is inputted to the serial input Din, and the comparator signal exhibits a high level only at portions thereof corresponding to those of the heat generation elements R1 to R64 whose temperatures are lower than the predetermined temperature. The comparator signal and the output of the shift register circuit 801 are logically ANDed by an AND circuit 44, and the shift register circuit 801 exhibits a high level only at stages thereof corresponding to those of the heat generation elements R1 to R64 whose temperatures are lower than the predetermined temperature. Consequently, energy is applied only to those heat generation elements R1 to R64. Reference numeral 46 denotes a switch (SW) for selectively inputting the output of the AND circuit 44 and the print input data Din to the shift register circuit 801.

The conventional thermal head apparatus described above, however, includes a comparatively large number of integrated circuits in the thermal head since it includes a heat generation driving circuit and a temperature detection circuit separately, and requires a high production cost since electric current detecting resistors are required by a number equal to the number of heat generation elements.

Further, where the conventional thermal head apparatus described above is used to print on a medium which has such a three layer structure of color developing layers for three primary colors as seen, for example, in FIG. 7 and wherein the density in color at a portion thereof contacting with a heat generation element increases for each color as the temperature of the heat generation element rises and the printing density varies in order of yellow, magenta and cyan as the temperature rises, when printing is performed for the cyan color developing layer of the lower layer of the medium, as driving of the heat generation element proceeds, the temperature of the heat generation element of the thermal head rises. However, since the temperature at the surface of the heat generation element and the temperature of the cyan layer of the medium exhibits a difference due to a transmission time of heat in heat transfer between them, before the cyan color developing temperature actually rises to an aimed temperature therefor, it is determined in error that the aimed temperature is reached, and consequently, driving of the heat generation element is stopped, resulting in printing in insufficient density.

SUMMARY OF THE INVENTION

It is an object of the present invention to provide a thermal head apparatus of the type which includes, as a heat generation element, a resistor member whose resistance value varies depending upon the temperature thereof, wherein the accuracy in detection of the temperature of a medium is improved to assure an improved quality of printing.

It is another object of the present invention to provide a thermal head apparatus of the type which includes, as a heat generation element, a resistor member whose resistance value varies depending upon the temperature thereof, wherein a thermal head includes a reduced number of parts and is simplified in structure.

In order to attain the objects described above, according to the present invention, a printing driving sequence and a temperature detection sequence are alternatively repeated in a time series, and printing driving control and temperature detection control are repetitively performed alternately in a time series in a same integrated circuit. In particular, according to an aspect of the present invention, there is provided a thermal head apparatus which comprises a heat generation member including a plurality of resistance elements each serving as a unit heat generation element and having an electric resistance whose value varies depending upon a temperature thereof, and a heat generation driving and temperature detection circuit for first driving the unit heat generation elements of the heat generation member in accordance with print data to generate heat and then detecting voltages across the unit heat generation elements to detect temperatures of the unit heat generation elements.

According to another aspect of the present invention, there is provided a thermal head apparatus which comprises a heat generation member including a plurality of resistance elements each serving as a unit heat generation element and having an electric resistance whose value varies depending upon a temperature thereof, a heat generation driving and temperature detection circuit for first driving the unit heat generation elements of the heat generation member in accordance with print data to generate heat and then successively detecting voltages across the unit heat generation elements to detect temperatures of the unit heat generation elements, and a control circuit for comparing the temperatures detected by the heat generation driving and temperature detection circuit with the print data and controlling the heat generation driving function of the heat generation driving and temperature detection circuit based on results of the comparison.

The thermal head apparatus may further comprise switch means for switching the heat generation driving and temperature detection circuit between a heat generation driving condition and a temperature detection condition.

With the thermal head apparatus of the present invention, In printing for which a thermosensible medium whose density of a developed color varies depending upon the temperature is used, high speed printing with a high quality can be realized by alternately and successively repeating heat generation driving and temperature detection of the heat generation elements of the thermal head. Further, since the time for heat generation driving and the time for temperature detection are provided separately, the two operation functions can be realized with a single general purpose integrated circuit. Consequently, the quantity of integrated circuits in the terminal head is reduced, for example, one half comparing with that of the conventional thermal head apparatus described hereinabove. Further, electric current detecting resistors, which are required by a number equal to the number of heat generation elements in the conventional thermal head apparatus, are not required at all by the thermal head of the thermal head apparatus of the present invention. Consequently, the thermal head is simplified in structure and accordingly can be produced at a reduced cost.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
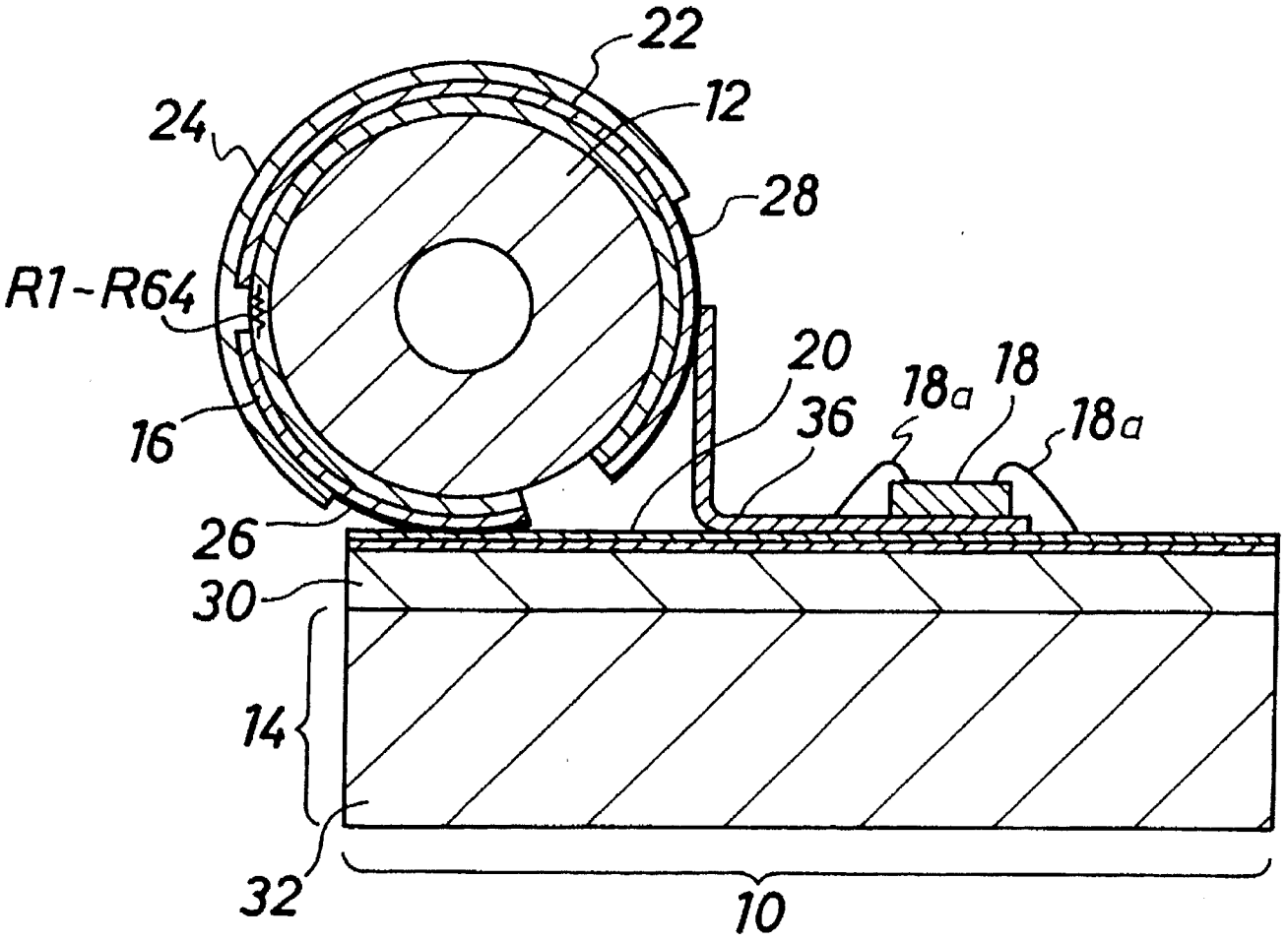
FIG. 1 is a sectional view showing the structure of a thermal head employed in a thermal head apparatus to which the present invention is applied.

Referring first to FIG. 1, there is shown in cross sectional view a thermal head employed in a thermal head apparatus to which the present invention is applied. The thermal head is generally denoted at 10 and includes a thermal head base member 12 and a mounting base plate 14. The thermal head base member 12 has a large number of heat generation elements R1 to R64 located in a row thereon and connected in parallel to each other. The thermal head base member 12 further has a large number of thermal head base member terminals 16 mounted thereon and individually connected to the heat generation elements R1 to R64. The mounting base plate 14 has a heat generation element controlling integrated circuit 18 mounted thereon. The heat generation element controlling integrated circuit 18 supplies electric currents to flow through the heat generation elements R1 to R64 and has another function of detecting the temperatures of the heat generation elements R1 to R64 after a fixed interval of time after electric currents are started to be supplied to the heat generation elements R1 to R64. The thermal head base member 12 exhibits the form of a cylinder made of, for example, an alumina ceramics material and has the heat generation elements R1 to R64 provided in a row extending in an axial direction on an outer surface thereof.

The thermal head base member terminals 16 are disposed in a row parallel to the row of the heat generation elements R1 to R64 and individually in alignment with the heat generation elements R1 to R64. The heat generation elements R1 to R64 are each formed from, for example, a thin film of a chromium-aluminum alloy having an electric resistance which exhibits a high temperature dependency. A common electrode 22 common to the heat generation elements R1 to R64 is provided on the outer surface of the thermal head base member 12 remote from the thermal head base member terminals 16 with respect to the heat generation elements R1 to R64. All of the heat generation elements R1 to R64 and most portions of the thermal head base member terminals 16 and the common electrode 22 are covered with and protected by a protective film 24. Portions of the thermal head base member terminals 16 and the common electrode 22 which are not covered with the protective film 24 have solder plated films 26 and 28 provided thereon.

The mounting base plate 14 includes an insulating substrate 30 made of, for example, an alumina ceramics material, and a holding plate 32 made of, for example, a synthetic resin. A plurality of mounting base plate terminals 20 each made of a thin film plated with gold are provided on the surface of the insulating substrate 30 in accordance with the pitch and the number of the thermal head base member terminals 16. Further, a flexible cable 36 is adhered to the mounting base plate terminals 20. The integrated circuit 18 has both of a function of energizing the heat generation elements R1 to R64 and another function of detecting the temperatures of the heat generation elements R1 to R64 as a result of such energization. The integrated circuit 18 is mounted on the flexible cable 36 and connected to the flexible cable 36 by way of gold wires 18*a*. The flexible cable 36 has a connection terminal pattern to an external control circuit of the thermal head 10.

It is to be noted that the control circuit may alternatively be accommodated in the thermal head 10. Further, while the thermal head in the present embodiment has the form of an end face head wherein heat generation elements are provided in an end face portion of the head, the present invention may be applied to a plane head wherein heat generation elements are embedded in a plane substrate.

Figure 2:
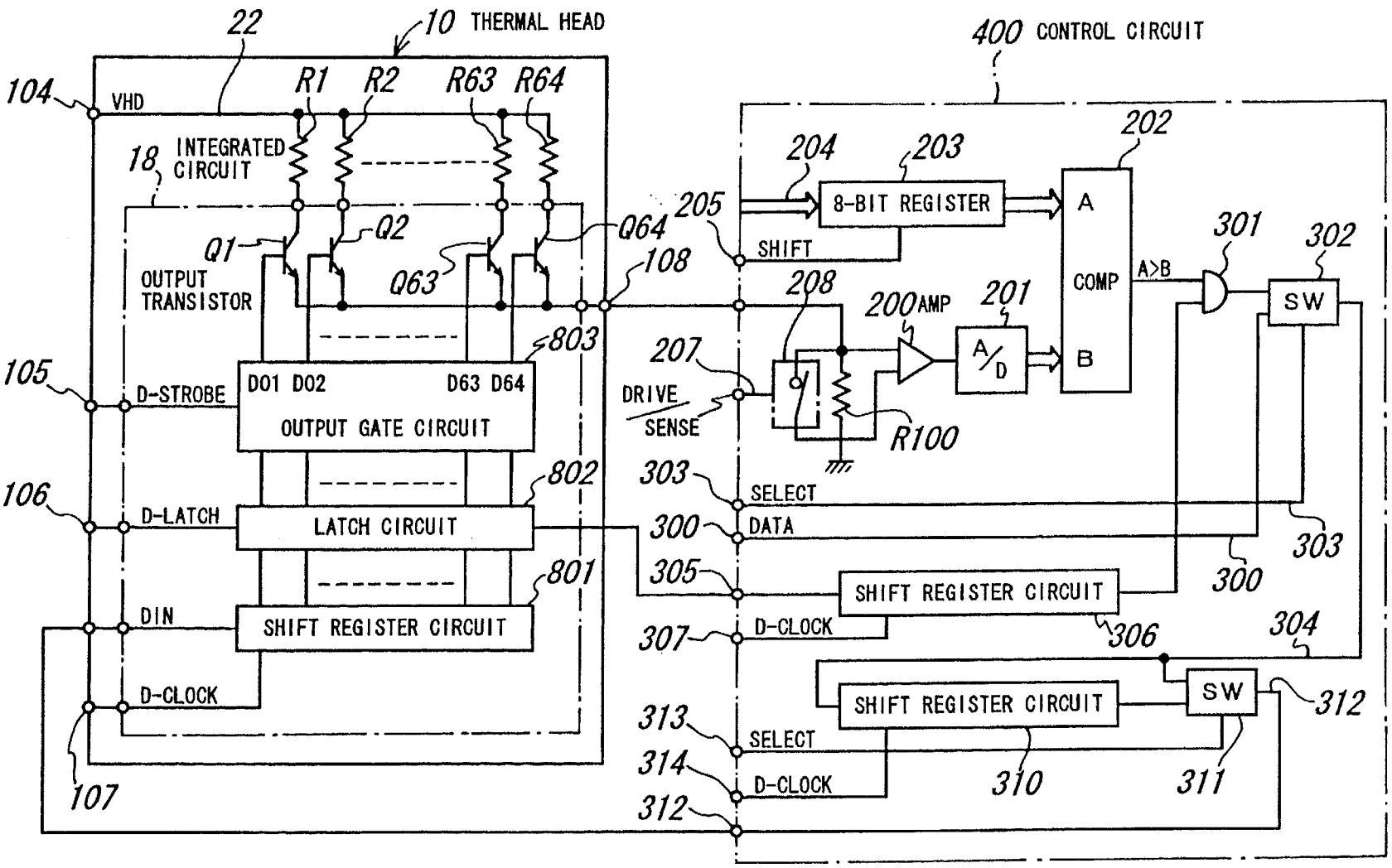
FIG. 2 is a circuit diagram of the thermal head shown in FIG. 1 and an external control circuit for the thermal head.
Figure 3:
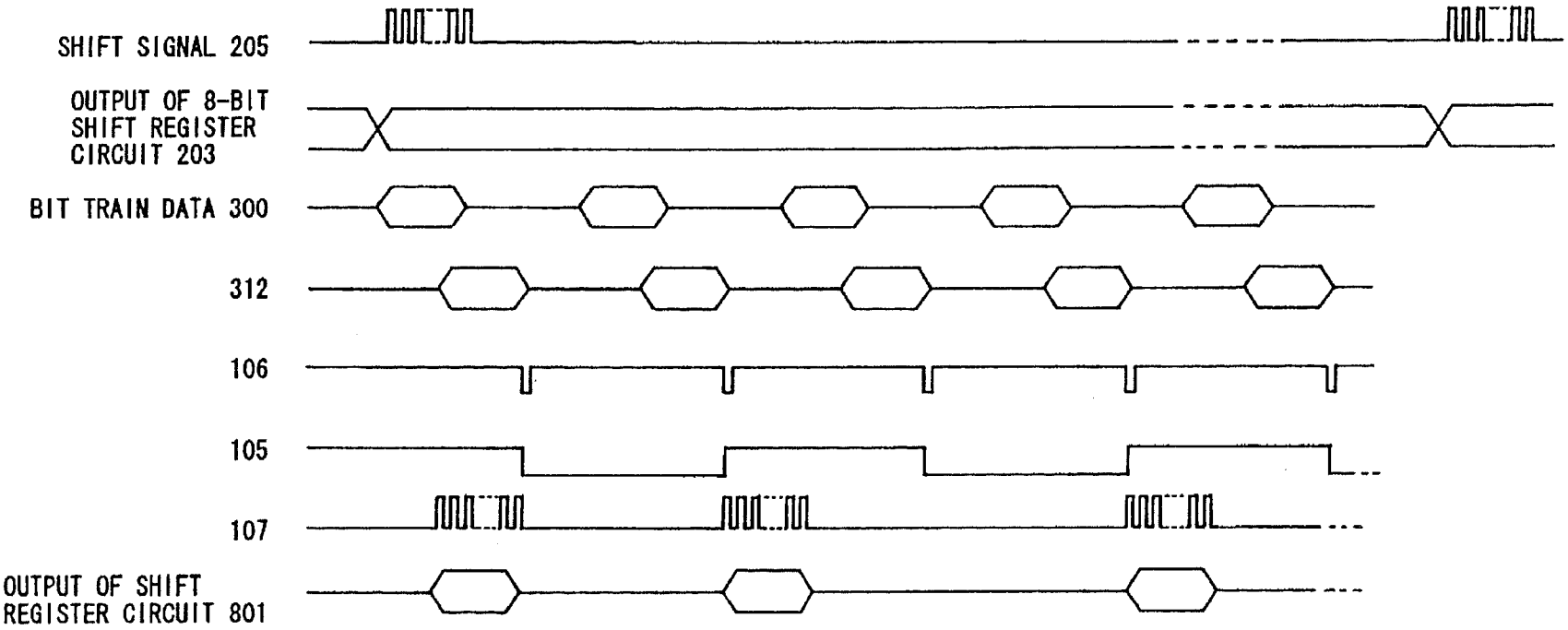
FIG. 3 is a time chart illustrating operation of the circuit arrangement shown in FIG. 2.
Figure 4:
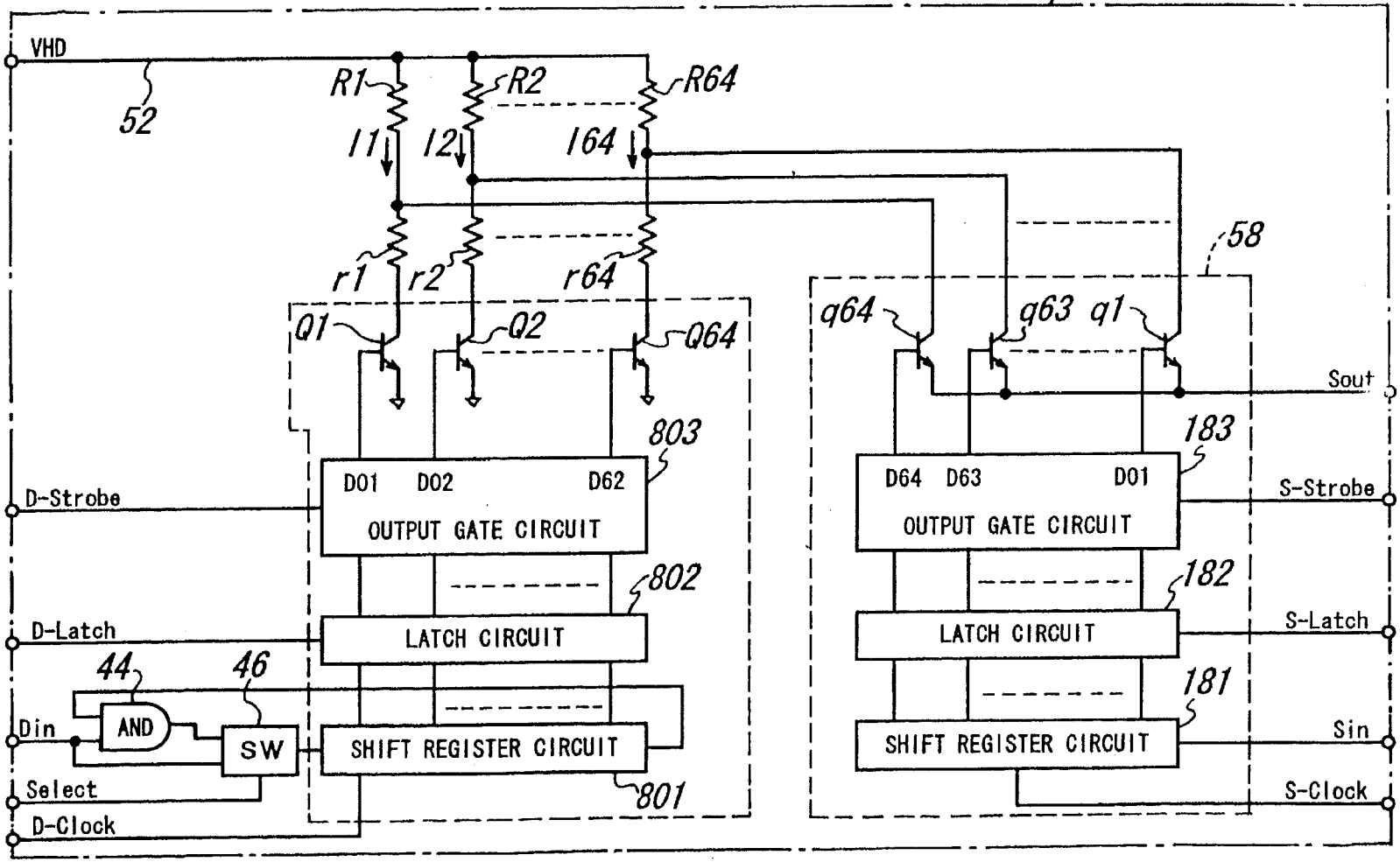
FIG. 4 PRIOR ART
FIG. 4 is a circuit diagram of a conventional thermal head.
Figure 5:
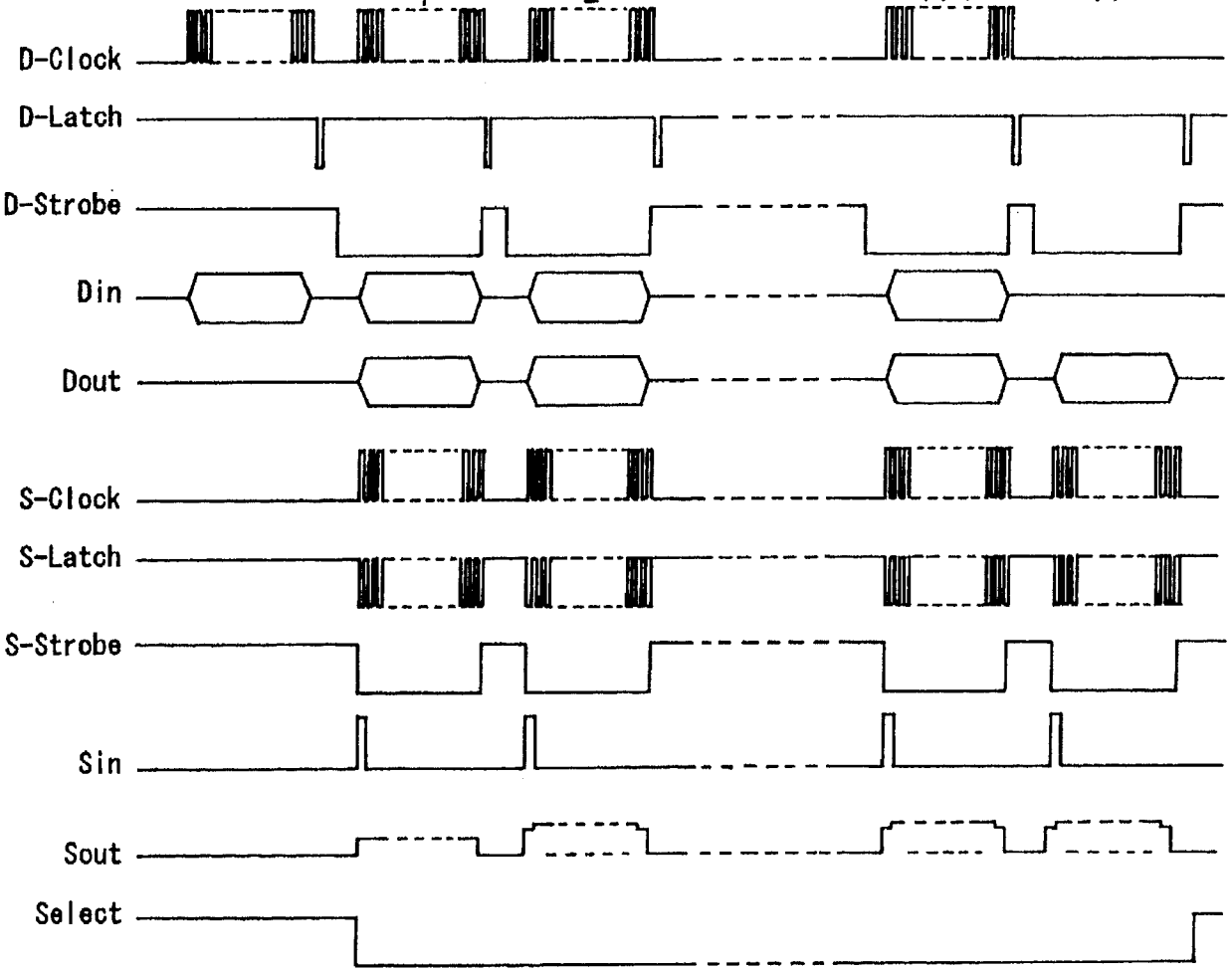
FIG. 5 PRIOR ART
FIG. 5 is a time chart illustrating operation of the thermal head of FIG. 4.
Figure 6:
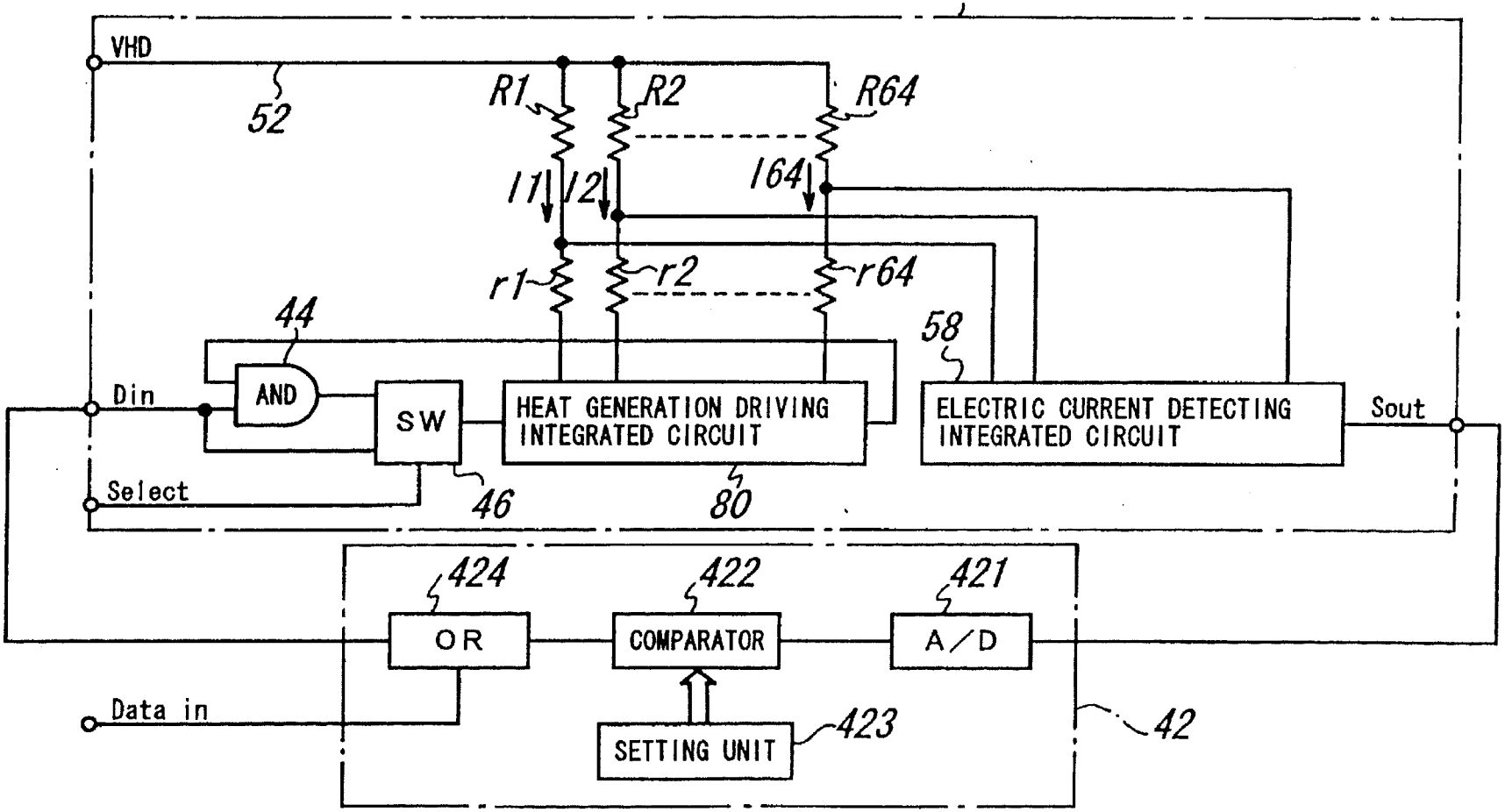
FIG. 6 PRIOR ART
FIG. 6 is a block diagram of the thermal head of FIG. 4 and a control circuit for the thermal head.
Figure 7:
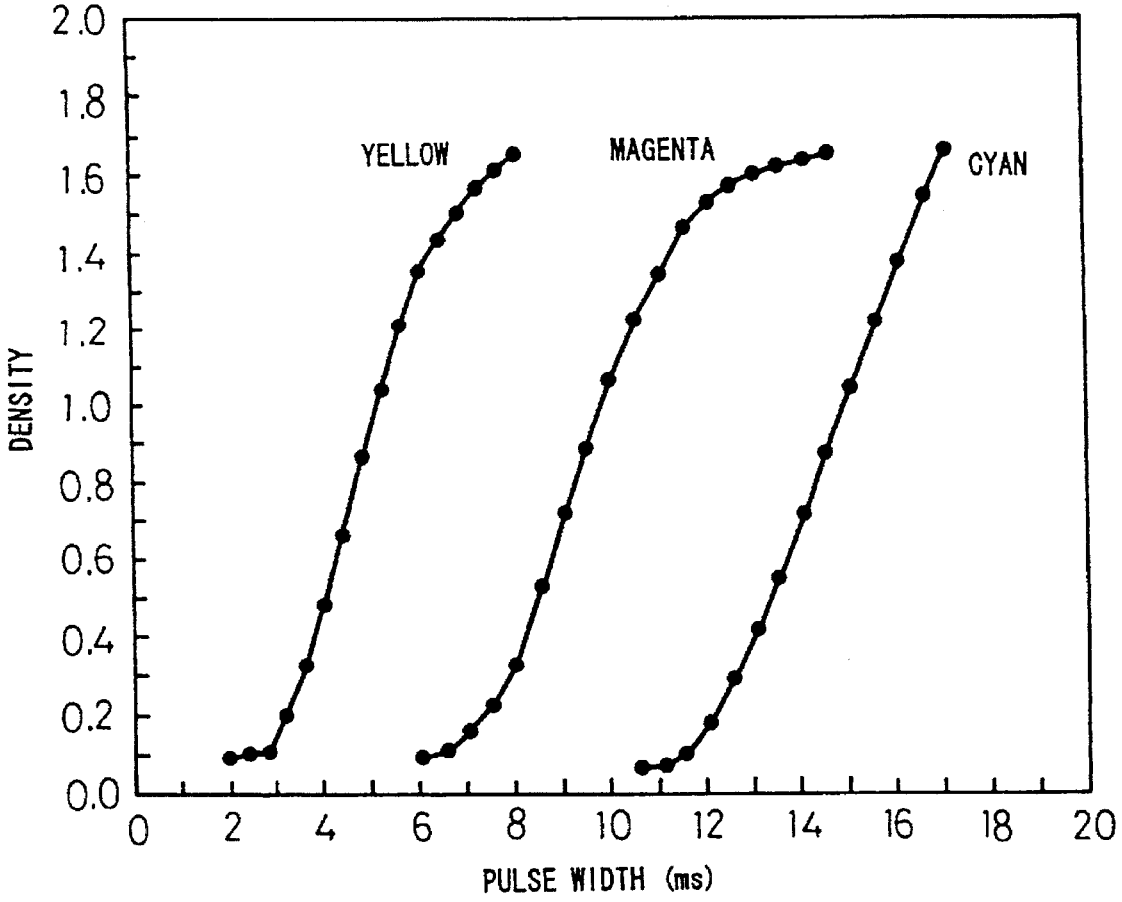
FIG. 7 PRIOR ART
FIG. 7 is a graph illustrating an example of a color developing characteristic of a conventional color thermosensible medium.

FIG. 2 shows in block diagram the thermal head 10 of FIG. 1 and the external control circuit, and FIG. 3 illustrates, in timing chart, operation of the circuitry shown in FIG. 2.

Referring to FIG. 2, all of one terminals of the 64 heat generation elements R1 to R64 are connected to the common electrode 22, and a dc power source voltage VHD is applied from a driving dc power source terminal 104 to the common electrode 22. The other terminals of the heat generation elements R1 to R64 are connected to the the electric current driving and temperature detecting integrated circuit 18. The integrated circuit 18 includes a shift register circuit 801, a latch circuit 802, an output gate circuit 803 and 64 output transistors Q1 to Q64. The integrated circuit 18 is an inexpensive general purpose current driving integrated circuit which is popularly employed in a thermal head of a facsimile apparatus or the like and has a timing at which it is used to control electric current driving of the heat generation elements R1 to R64 and another timing at which it is used to detect the temperatures of the heat generation elements R1 to R64. Thus, two different objects in use are realized.

Prior to printing, print data are received from a host apparatus. The print data include two different types of data one of which is density information data for each 64 dots/line. In particular, where, for example, 256 different gradations are represented by density information, density data 204 of 8 bits, that is, one byte, per one element, and consequently of totalling 64 bytes corresponding to the heat generation elements R1 to R64, are set to an eight-bit register 203 in the control circuit 400 in response to a shift signal 205. Contents of the set data of the eight-bit register 203 do not vary until after a printing operation for one line is completed, and prior to starting of printing for a next line, the data for the preceding line are replaced by 64 bytes of new density information sent thereto from the host apparatus.

The other kind of data passed on from the host apparatus is bit train data which exhibit "1" for all 64 bits/line. The data of "1" for all bits indicate that all of the heat generation elements R1 to R64 should be energized upon starting of printing. The data of "1" are inputted from the host apparatus to a signal line 300, pass a pair of switches (SW) 302 and 311 and are set by way of a signal line 312 to the shift register circuit 801 of the integrated circuit 18 in the head. It is to be noted that, when the heat generation elements R1 to R64 are to be energized, the switches 302 and 311 pass the bit train data 300 in response to signals 303 and 313, respectively. When all of the bit train data are "1", all of the heat generation elements R1 to R64 are energized upon starting of printing as hereinafter described. However, the energization time per one printing driving sequence is so short that, even if the data are successively set to "1", the recording medium will not develop any color within several printing driving sequences. Some recording medium exhibits a high "degree of white" (clear white) when it is heated to such a degree at which it develops no color, and accordingly, at an initial stage of printing, the recording medium is heated intentionally.

The bit train data of all "1" set in the shift register circuit 801 are set to the latch circuit 802 at the timing of a D-LATCH signal 106. Simultaneously, a switch 208 in the control circuit 400 is put into an on-state in response to a signal 207 from the host apparatus. As a result, the emitter terminals of all of the output transistors Q1 to Q64 in the integrated circuit 18 are grounded. Then, an input signal (D-STROBE) 105 to the output gate circuit 803 in the integrated circuit 18 is set to "1" by the host apparatus, and all bits of the output gate circuit 803 are outputted and remain outputted for a period of time while the input signal (D-STROBE) 105 remains at "1". Consequently, the output transistors Q1 to Q64 are changed simultaneously into an on-state, whereupon the heat generation elements R1 to R64 of the thermal head 10 are energized at a time, starting a rise in temperature thereof.

While the input signal (D-STROBE) 105 remains at "1", the temperature rise continues. The period within which the signal 105 is "1" is a printing driving period and is normally fixed for printing of a same hue. As described above, the signal 105 is outputted by a plurality of times alternately with the timing for temperature detection hereinafter described. At a timing immediately before the period within which the signal 105 remains "1" comes to an end, the contents of 64 bits of the shift register circuit 801 are transferred to a shift register circuit 306 in response to shift clock signals 107 and 307. Then, data of "1", "0", "0", . . . and "0" are set to the shift register circuit 801 by way of the switch 302 from the data signal 300 of the control circuit 400. In particular, the value "1" is set to the leftmost bit of the shift register circuit 801 while the value "0" is set to all of the other bits of the shift register circuit 801. This is preparations to always cause only one of the transistors Q1 to Q64 in the integrated circuit 18 to exhibit an on-state within a period for temperature detection after a period for printing driving when the signal 105 is "1" comes to an end. It is to be noted that the shift register circuit 801 in the integrated circuit 18 is of the first-in first-out type while the shift register circuit 306, another shift register circuit 310 and the eight-bit register 203 of the control circuit 400 are of the first-in last-out type. After the printing driving period within which the signal 105 is "1" comes to an end, all of the output transistors Q1 to Q64 in the integrated circuit 18 change to an off-state once since the outputs of the output gate circuit 803 exhibit an off-state.

Thereafter, a temperature detection sequence is entered. Here, the signal 207 to the control circuit 400 is reversed to turn the switch 208 off. As a result, the emitters of the output transistors Q1 to Q64 in the integrated circuit 18 are grounded by way of a fixed resistor R100 of the control circuit 400. Then, the contents of the shift register circuit 801 in the integrated circuit 18 are set to the latch circuit 802 in response to the signal 106. As a result, since only the left end bit of the shift register circuit 801 is "1" at an initial stage as described above, the output of the leftmost end of the output gate circuit 803 changes to "1" at the timing of the D-STROBE signal 105, and only the transistor Q1 changes to an on-state. As a result, a voltage drop only of the heat generation element R1 from among the heat generation elements R1 to R64 is connected to the fixed resistor R100 by way of an output terminal 108. Consequently, a voltage obtained by dividing the dc voltage VHD applied to the head by the resistor R1 and the resistor R100 appears across the resistor R100. The voltage appearing across the resistor R100 increases as the temperature of the resistor R1 rises and the resistance value of the resistor R1 drops. Reversely speaking, this indicates that the temperature of the resistor R1 can be discriminated from the voltage across the resistor R100. The voltage across the resistor R100 is first amplified by an amplification circuit 200 and then converted into a digital value of 8 bits by an analog to digital converter (A/D) 201. The 8-bit data is inputted to a comparator (COMP) 202, by which it is compared in magnitude with 8 bits of printing density information for each bit from the eight-bit register 203.

If a result of the comparison proves that the value of the analog to digital converter 201 is lower than the value from the eight-bit register 203, the output of the comparator 202 exhibits "1" which represents that a predetermined temperature is not reached as yet. The output of the comparator 202 is logically ANDed with the output of the shift register circuit 306 by an AND gate 301. Since the contents of the shift register circuit 306 are set to "1" at an initial stage, the output of the AND gate 301 is "1". This value passes the switch 302 and is set to the shift register circuit 310.

Then, the data signal 300 from the host apparatus, that is, the data of "0", "1", "0", "0", . . . "0", and "0" wherein the second leftmost bit exhibits the value "1" while the other bits exhibit the value "0", passes through the switches 302 and 311 and is set to the shift register circuit 801, whereafter it is transferred to the latch circuit 802 in a similar manner as described above. As a result, only the transistor Q2 is turned on at the timing of the D-STROBE signal 105, and a voltage corresponding to the temperature of the resistor R2 appears across the resistor R100. This voltage passes through the amplification circuit 200 and the analog to digital converter 201 and is compared with the density data at the second byte of the eight-bit register 203. Then, as far as the analog to digital converter 201 remains lower than the output of the eight-bit register 302, the value "1" is set to the shift register circuit 310.

Thereafter, the outputs of the transistors Q3 to Q64 are successively compared, as a value of the analog to digital converter 201, with print density information from the eight-bit register 203, and a result of each of such results is set to the shift register circuit 310 in a similar manner as described above. Each time the value of the analog to digital converter 201 is determined to be higher than the value of the eight-bit register 203, this signifies that the temperature of the corresponding heat generation element is higher than the preset temperature and the density of a result of printing is higher than a predetermined printing density. In this instance, the output of the comparator 202 exhibits the value "0", and consequently, the corresponding bit of the shift register circuit 310 is set to "0". After the operation described above up to the transistor Q64 is completed, the temperature detection sequence comes to an end, and printing driving of the heat generation elements R1 to R64 is resumed. The switch 208 is switched on again.

Prior to this, contents of the shift register circuit 310 are transferred to the shift register circuit 801 by way of the switch 311. In this instance, each bit of the contents of the shift register circuit 801 to which "0" is set indicates that the predetermined printing density has been reached already. Accordingly, when the transistors Q1 to Q64 are to be energized by way of the output gate circuit 803 with the data set in the latch circuit 802, each of bits of "0" cannot turn on the corresponding transistor. Consequently, those of the heat generation elements R1 to R64 which correspond to "0" are not energized to generate heat. Immediately before the second printing driving sequence comes to an end, contents of the shift register circuit 801 are set to the shift register circuit 306 again and the switch 208 is turned off again in a similar manner as in the first printing driving sequence. Thereafter, another temperature detection sequence is entered. Here, since the temperatures of the heat generation elements R1 to R64 gradually rise, the output of the analog to digital converter 201 exhibits a higher value than the set printing density information data of the eight-bit register 203, and after the cycle of the printing driving sequence and the temperature detection sequence is repeated, all of the bits of the shift register circuit 310 are finally changed to "0". As a result, printing driving of the heat generation elements R1 to R64 is stopped, and printing is completed with all of the bits printed with the predetermined density. In this condition, the printing operation of the line comes to an end. Thereafter, either the medium is fed or the thermal head is moved by one line space, and then a printing operation for a next line is performed.

It is to be noted that, upon the printing operation described above, any of the heat generation elements R1 to R64 may be energized, when it becomes cool and the temperature thereof drops after the temperature thereof rises to the predetermined temperature once and its energization is stopped and consequently the value of the analog to digital converter 201 becomes lower than the value of the eight-bit register 203, to generate heat, resulting in failure to print with a correct density on the medium. In such an instance, however, since contents of the shift register circuit 801 are transferred to the shift register circuit 306 upon completion of a printing driving sequence, the corresponding output bit of the shift register circuit 306 connected to the input terminal of the AND gate 301 in a subsequent temperature detection sequence is "0", and consequently, the AND gate 301 outputs "0". Accordingly, the value "1" is not set to the shift register circuit 310 any more. Consequently, any heat generation element which has become cool will not be energized again in the same line.

While the thermal head apparatus of the present embodiment is designed for a printing operation wherein printing is performed at a time in a lateral direction on a printing medium by means of a line head which includes the 64 heat generation elements R1 to R64 arranged in a row, the present invention can be applied to simultaneous printing in a longitudinal direction using a serial head or printing of a different number of dots.

The thermal head apparatus of the present embodiment can be applied not only to a thermosensible color printer but also to printing with ordinary monochromatic thermosensible paper and particularly to image printing having shades of color. Since temperature control is easy for ordinary monochromatic character pattern printing, high speed printing with a fixed density can be achieved.

Having now fully described the invention, it will be apparent to one of ordinary skill in the art that many changes and modifications can be made thereto without departing from the spirit and scope of the invention as set forth herein.

What is claimed is:

1. A thermal head apparatus, comprising:

a heat generation member including a plurality of resistance elements each serving as a unit heat generation element and having an electric resistance whose value varies depending upon a temperature thereof; and a heat generation driving and temperature detection circuit for first driving said unit heat generation elements of said heat generation member in accordance with a bit train data portion of print data to generate heat and then detecting voltages across said unit heat generation elements to detect temperatures of said unit heat generation elements for comparison to a density information data portion of said print data.

2. A thermal head apparatus, comprising:

a heat generation member including a plurality of resistance elements each serving as a unit heat generation element and having an electric resistance whose value varies depending upon a temperature thereof; and a heat generation driving and temperature detection circuit for first driving said unit heat generation elements of said heat generation member in accordance with a bit train data portion of print data to generate heat and then successively detecting voltages across said unit heat generation elements to detect temperatures of said unit heat generation elements; and a control circuit for comparing the temperatures detected by said heat generation driving and temperature detection circuit with a density information data portion of the print data and controlling the heat generation driving function of said heat generation driving and temperature detection circuit based on results of the comparison.

3. A thermal head apparatus as claimed in claim 1 or 2, further comprising switch means for switching said heat generation driving and temperature detection circuit between a heat generation driving condition and a temperature detection condition.

* * * * *